US007017649B2

(12) United States Patent
Kubota

(10) Patent No.: US 7,017,649 B2
(45) Date of Patent: Mar. 28, 2006

(54) DIE CASTING MACHINE AND CASTING METHOD

(75) Inventor: Shoko Kubota, Kanagawa (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/846,921

(22) Filed: May 17, 2004

(65) Prior Publication Data

US 2004/0256073 A1 Dec. 23, 2004

(30) Foreign Application Priority Data

May 16, 2003 (JP) ..... 2003-138333

(51) Int. Cl.
*B22D 17/32* (2006.01)

(52) U.S. Cl. ..... 164/457; 164/155.3; 164/155.4; 164/155.5; 164/65; 164/113; 164/305; 164/314

(58) Field of Classification Search ..... 164/65, 164/113, 305, 314, 457, 155.3, 155.4, 155.5
See application file for complete search history.

(56) References Cited

U.S. PATENT DOCUMENTS

| | | | | |
|---|---|---|---|---|
| 2,785,448 | A | 3/1957 | Hodler | 164/305 |
| 4,463,793 | A * | 8/1984 | Thurner | 164/155.5 |
| 5,022,457 | A * | 6/1991 | Iwamoto et al. | 164/155.3 |
| 6,808,008 | B1 * | 10/2004 | Kubota | 164/305 |

* cited by examiner

*Primary Examiner*—Kevin Kerns
*Assistant Examiner*—I.-H. Lin
(74) *Attorney, Agent, or Firm*—Pillsbury Winthrop Shaw Pittman, LLP

(57) ABSTRACT

A die casting machine obtain to obtain a suitable reduced pressure and reliably prevent the entry of molten metal into a valve when reducing the pressure in a cavity and injecting and filling it with a molten metal for casting, provided with the valve for opening and closing an exhaust path, a position detector for detecting an open/closed state of the exhaust path by the valve, an injection apparatus, a position detector for detecting the position of the injection plunger, and a control apparatus for controlling the injection. The control apparatus outputs a control instruction for making it close the exhaust path to the valve when the detected position of the injection plunger reaches a valve closing position set before the speed switching position and stops the drive of the injection plunger when not detecting completion of closure of the exhaust path when the injection plunger reaches the speed switching position.

2 Claims, 4 Drawing Sheets

DIE CASTING MACHINE AND CASTING METHOD

BACKGROUND OF THE INVENTION

1. Field of Invention

The present invention is relates to a die casting machine, more particularly relates to a die casting machine using a vacuum die casting method for exhausting a gas inside a die cavity before injecting and filling a molten metal and casting under reduced pressure.

2. Description of the Related Art

One of the reasons for variations in quality of die cast products and the resultant drop in reliability is gas contained in the die cast products. That is, the molten metal injected and filled at a high speed and high pressure forms turbulence inside the injection sleeve and die cavity resulting in entrainment of air or vaporized release agent coated on the die.

To overcome this disadvantage, there is known the technology of casting using a die casting machine using the vacuum die casting method so as to suppress entrainment of gas in the die cast products and thereby reduce variations in quality due to content of gas in the die cast products (for example, see U.S. Pat. No. 2,785,448).

In a die casting machine using the vacuum die casting method, the die cavity has to be able to be made greater in vacuum and the reduced pressure state maintained in order to cast a high strength and quality product. If the die cavity is not made high in vacuum, the cast product may contain gas. As a result, when applying annealing or other heat treatment to the product after casting, the product will easily suffer from warping or deformation and it will be difficult to obtain a sufficient effect by the vacuum die casting method.

Summarizing the disadvantages to be solved by the invention, to reduce the pressure in the cavity, it is necessary to provide a valve in the exhaust path communicating a vacuum pump and the cavity and use this valve to open and close the exhaust path.

From the viewpoint of preventing the drop in vacuum degree in the cavity, the timing of closing the valve is preferably right before injecting and filling the cavity with the molten metal.

On the other hand, if the timing of closing of the valve becomes delayed, the molten metal may enter the valve and the valve may be damaged.

Therefore, it is necessary to optimize the timing of closing the valve so as to obtain a suitable pressure drop and prevent entry of molten metal into the valve.

However, the timing of closing the valve easily fluctuates due to various factors such as the variation in response of valves. Molten metal may therefore enter the valve even if closing the valve at a timing with a certain leeway.

SUMMARY OF THE INVENTION

An object of the present invention is to obtain a suitable reduced pressure and reliably prevent the entry of molten metal into a valve when reducing the pressure in a cavity and injecting and filling it with the molten metal for casting.

According to a first aspect of the invention, there is provided a die casting machine for exhausting a cavity defined between a pair of dies to reduce the pressure and injecting and filling a molten metal into the reduced pressure cavity to form a cast product, comprising a valve for opening and closing an exhaust path for exhausting the inside of the cavity; an operation detecting means for detecting an open/closed state of the exhaust path by the valve; an injection apparatus provided with an injection sleeve communicated with the valve, an injection plunger for injecting the molten metal supplied to the injection sleeve, and a drive means for driving the injection plunger; a plunger position detecting means for detecting a position of the injection plunger; and a control means for driving the injection plunger by a low speed injection speed after the molten metal is supplied to the injection sleeve, switching to a high injection speed when a set speed switching position is reached, and making the molten metal be injected and filled into the reduced pressure cavity; the control means outputting a control instruction for making it close the exhaust path to the valve when the detected position of the injection plunger reaches a valve closing position set before the speed switching position and stops the drive of the injection plunger when not detecting completion of closure of the exhaust path when the injection plunger reaches the speed switching position.

Preferably, the machine further comprises a closing position deciding means for deciding on the valve closing position before casting based on the casting conditions.

According to a second aspect of the invention, there is provided a casting method for exhausting a cavity defined between a pair of dies to reduce the pressure and injecting and filling a molten metal into the reduced pressure cavity to form a cast product, comprising: feeding the molten metal to an injection sleeve communicated with the cavity; driving an injection plunger for injecting the molten metal at a low injection speed after the molten metal is supplied to the injection sleeve; starting reduction of pressure inside the cavity and outputting an instruction to a valve for opening and closing an exhaust path for exhausting the inside of the cavity so as to make it close the exhaust path when a position of the injection plunger reaches a preset valve closing position; and detecting if the closing operation of the exhaust path has been completed before the position of the injection plunger reaches a speed switching position set in front of the valve closing position and, if it has, switching to a high injection speed and injecting and filling the reduced pressure cavity with the molten metal and, if it has not, stopping the drive of the injection plunger.

Preferably, the method further comprises deciding on the valve closing position before casting based on the casting conditions.

In the present invention, if the completion of the closing operation of the exhaust path is not detected before the injection plunger reaches the speed switching position, the drive of the injection plunger is stopped. That is, if the completion of the closing operation of the exhaust path is not detected, the high injection speed is not switched to. In the state where the closing operation of the exhaust path has not been completed, the molten metal is not injected and filled into the cavity by the high injection speed, so entry of the molten metal into the valve can be reliably prevented.

Further, in the present invention, the timing of closing the valve is determined by the position of the injection plunger and the valve closing position is determined based on the casting conditions. As a result, for example, a valve closing position giving a suitable pressure drop is determined from the preset speed switching position, injection speed, or other casting conditions.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below while referring to the attached figures.

Figure 1:
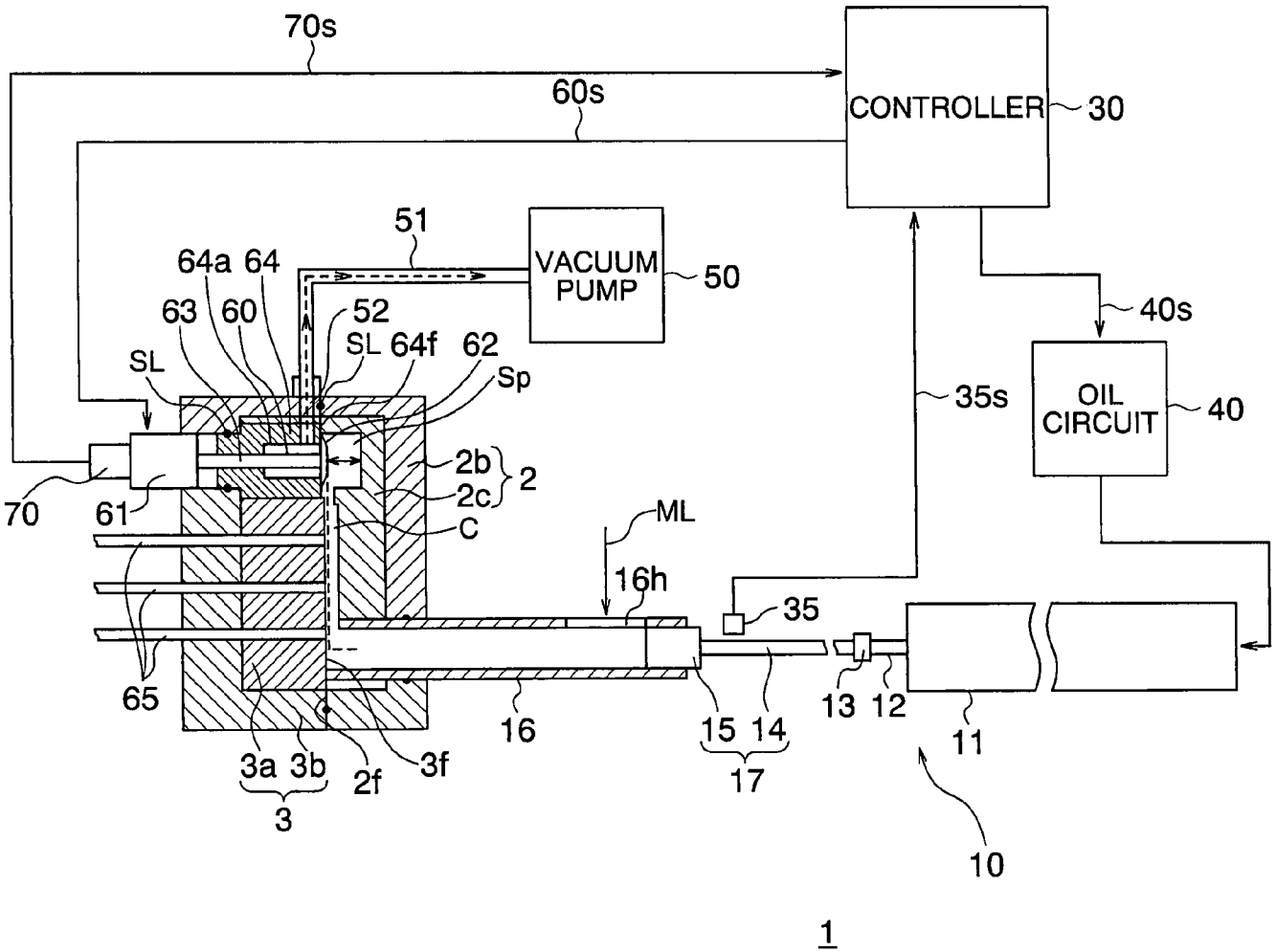
FIG. 1 is a cross-sectional view of the structure of a die casting machine according to a first embodiment of the present invention around the die.

FIG. 1 is a cross-sectional view of the structure of a die casting machine according to a first embodiment of the present invention around the die.

A die casting machine 1 is provided with a fixed die 2, a movable die 3, an injection apparatus 10, a control apparatus 30, an oil pressure circuit 40, a vacuum pump 50, and a valve 60. The fixed die 2 and the movable die 3 correspond to the pair of dies of the claims of the present invention, the injection apparatus 10 and the oil pressure circuit 40 correspond to the injection apparatus of the claims of the present invention, and the control apparatus 30 corresponds to the control means of the claims of the present invention.

The fixed die 2 is comprised of a plurality of members 2*a* and 2*b*. This fixed die 2 is fixed to a fixed die plate of a not shown mold clamping apparatus. The movable die 2 has an injection sleeve 16 of the later explained injection apparatus 10 fixed to it.

The movable die 2 is comprised of a plurality of members 3*a* and 3*b*. This movable die 3 is integrally provided with the valve 60. Further, the movable die 3 is provided with a plurality of movable eject pins 65.

The fixed die 2 and the movable die 3 shown in FIG. 1 are in a clamped state. The fixed die 2 is fixed to a fixed die plate of a not shown mold clamping apparatus, while the movable die 3 is fixed to a movable die plate of a not shown clamping apparatus. For example, a toggle mechanism etc. is used to press the movable die plate to the fixed die plate by a predetermined pressure and clamp the fixed die 2 and the movable die 3.

The surface 2*f* of the fixed die 2 and the surface 3*f* of the movable die 3 are joined to define between them a cavity C for casting a cast product. The joining face 2*f* of the fixed die 2 and the joining face 3*f* of the movable die 3 are also provided between them with a seal member SL for sealing the joining face 2*f* and joining face 3*f*. This seal member SL is for example made of silicone rubber.

The movable die 3 is provided with the valve 60. The valve 60 corresponds to the valve of the claims of the present invention. This valve 60 has an electromagnetic actuator 61, a valve body 62, a valve shaft 63, and a valve seat member 64.

The valve seat member 64 is a cylindrical member having a through hole 64*a* and is buried in the movable die 3. The valve seat member 64 and the member 3*b* of the movable die 3 are provided with a seal member SL between them. The valve seat member 64*f* is arranged at a position where the valve seat face 64*f* is mated with the joining face 3*f* of the movable die 3. The movable die 3 and valve seat member 64 are formed with an exhaust path 52 for communicating with the through hole 64*a* of the valve seat member 64. This exhaust path 52 is connected to an exhaust pipe 51. This exhaust pipe 51 is connected in turn to the vacuum pump 50.

The valve shaft 63 is inserted into the through hole 64*a* of the valve seat member 64. The electromagnetic actuator 61 is used to drive it in the direction shown in FIG. 1. The fixed die 2 and the movable die 3 form between them a space Sp in which the valve body 62 provided at the front end of the valve shaft 63 can move. This space Sp is communicated with the cavity C. Therefore, the cavity C is communicated with the exhaust pipe 51 through the space Sp, through hole 64*a* of the valve seat member 64, and exhaust path 2.

The valve body 62 provided at the front end of the valve shaft 63 is driven to the valve seat member 64 side, whereby it contacts with the valve seat face 64*f* of the valve seat member 64. Due to this, the exhaust path connecting the cavity C and exhaust pipe 51 is closed. The valve body 62 is driven to the fixed die 2 side, whereby the exhaust path connecting the cavity C and the exhaust pipe 51 is opened.

The electromagnetic actuator 61 is driven upon a control instruction 60*s* from the control apparatus 30. One end of the electromagnetic actuator 61 is provided with a position detector 70 for detecting the position of the valve body 62 (valve shaft 63) in the axial direction. The position detection signal 70*s* of the position detector 70 is input to the later explained control apparatus 30. The position of the valve body 62 is servo controlled by the control apparatus 30 by the position detection signal 70*s* of the position detector 70 being fed back to the control apparatus 30. Further, by detecting the position of the valve body 62 by the position detector 70, it is possible to detect the open/closed state of whether the valve body 62 has opened the exhaust path 52 or has closed the exhaust path 52. The position detector 70 and the processing of the control apparatus 30 explained later comprise the operation detecting means of the claims of the present invention.

The injection apparatus 10 is provided with an injection sleeve 16, an injection plunger 17 comprised of a plunger rod 14 and a plunger tip 15, and an oil pressure cylinder 11. The oil pressure cylinder 11 and the oil pressure circuit 40 comprise the drive means of the claims of the present invention. The injection sleeve 16 is comprised of a cylindrical member, is fixed to the fixed die 2, and is communicated with the above-mentioned cavity C. The rear end side of the injection sleeve 16 is formed with a feed port 16*h* for feeding the molten metal.

The plunger tip 15 is fixed to one end of the plunger rod 14 and fit inside the injection sleeve 16. By the plunger tip 15 moving forward from the feed port 16*h*, the injection sleeve 16 is closed from the outside. The plunger rod 14 is connected at the other end to a piston rod 12 of the oil pressure cylinder 11 through a coupling 13. The oil pressure cylinder 11 is driven by the pressurized oil of a predetermined pressure and makes the piston rod 12 extend and retract.

The plunger rod 14 is provided with a position detection sensor 35. The position detection sensor 35 corresponds to the plunger position detecting means of the claims of the present invention. The outer circumference of the plunger rod 14 is formed with magnetic poles at a constant pitch in the axial direction. The position detection sensor 35, for example, detects changes in the magnetic poles of the moving plunger rod 14 and outputs the changes in the magnetic poles converted to a pulse signal. The position detection sensor 35 outputs a detection signal 35*s* to the control apparatus 30. The control apparatus 30 calculates the position and speed of the injection plunger 17 based on the detection signal 35 comprised of the pulse signal.

The oil pressure circuit 40 is connected to an accumulator or other oil pressure source. Upon receiving a control signal 40*s* from the control apparatus 30, it supplies high pressure pressurized oil to the oil pressure cylinder 11. The oil pressure circuit 40 supplies the oil pressure cylinder 11 with high pressure pressurized oil, whereby the injection apparatus 10 performs its injection operation.

The vacuum pump 50 exhausts the cavity C formed between the movable die 3 and the fixed die 2 through the exhaust pipe 51.

Figure 2:
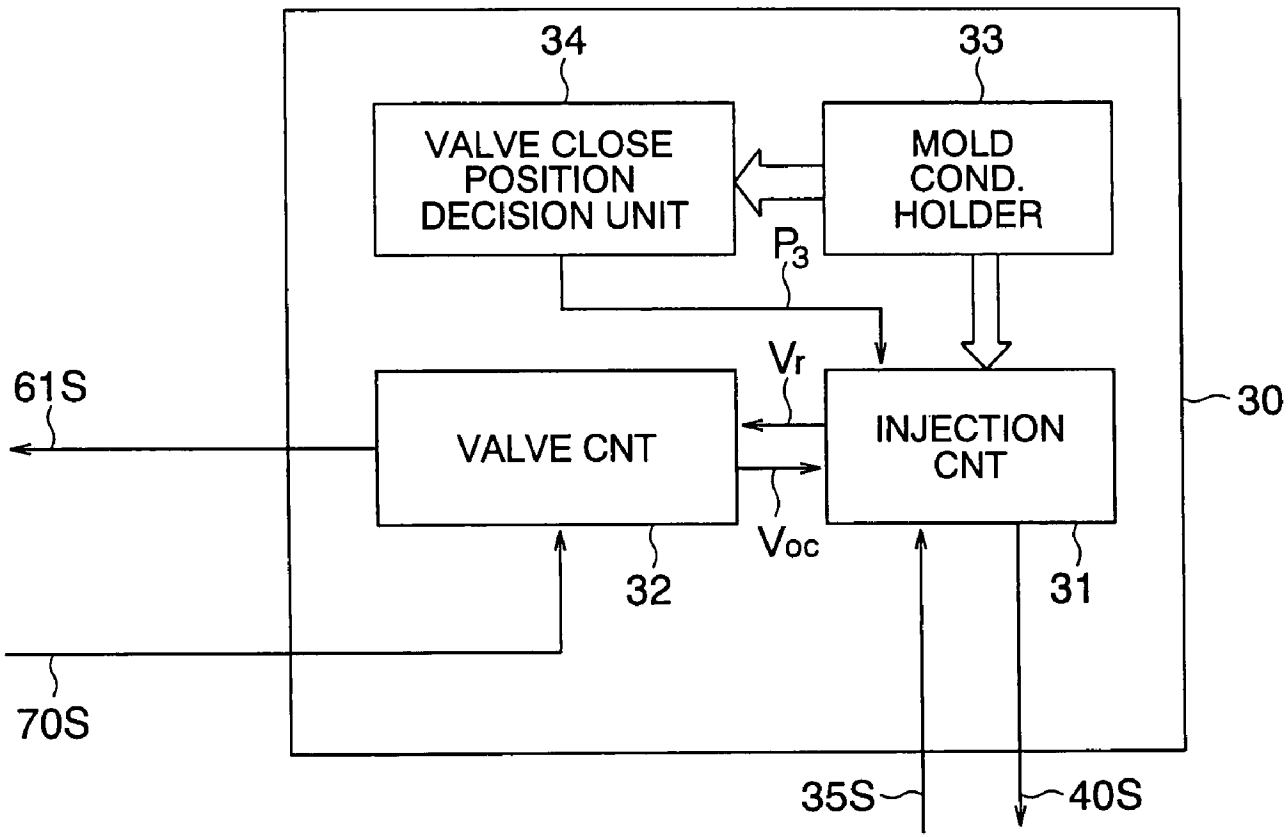
FIG. 2 is a functional block diagram of a control apparatus.

FIG. 2 is a functional block diagram of the control apparatus 30. The control apparatus 30 has an injection control unit 31, a valve control unit 32, a casting condition holding unit 33, and a valve closing position determining unit. The valve closing position determining unit 34 corresponds to the closing position determining means of the claims of the present invention. Further, the control apparatus 30 controls the die casting machine 1 as a whole and controls the injection apparatus 10, valve 60, vacuum apparatus, mold clamping apparatus, molten metal feed apparatus, etc. It has functions other than those described above, but their explanations are omitted.

The valve control unit 32 receives an instruction Vr from the injection control unit 31, generates a drive signal 61*s* for driving the valve 60 by the position detection signal 70*s* of the position detector 70 being fed back, and outputs it to the electromagnetic actuator 61. Due to this, the valve body 62 of the valve 60 is servo controlled so as to track the target position in accordance with the instruction Vr. Further, the valve control unit 32 outputs to the injection control unit 31 an open/closing completion signal Voc showing the completion of the opening or completion of the closing of the valve 60 based on the position detection signal 70*s* of the position detector 70 fed back to it.

The injection control unit 31 generates a control signal 40*s* for driving the injection apparatus 10 and outputs it to the oil pressure circuit 40. Basically, after the injection sleeve 15 is supplied with the molten metal, the injection plunger 17 is driven at a low injection speed. When the set speed switching position is reached, the high injection speed is switched to, whereupon the reduced pressure cavity C is injected and filled with molten metal. Further, when the cavity C is filled with molten metal and the injection plunger 17 reaches the set pressure increase start position, the pressure of the injection plunger 17 is raised to raise the casting pressure. The specific processing of the injection control unit 31 will be explained later.

The casting condition holding unit 33 holds the various conditions for casting. The injection control unit 31 controls the injection using the casting conditions held by the casting condition holding unit 33. As the casting conditions, for example, the injection speed, the speed switching position, the pressure increase, and various other parameters are defined. Further, these casting conditions include the response of the valve 60, the performance of the vacuum pump 50, and other conditions of mechanisms required for casting.

The valve closing position determining unit 34 determines a position P3 of the injection plunger 17 for outputting an instruction for closing the valve 60 based on the response of the valve 60 and the various casting conditions held in the casting condition holding unit 33. The valve closing position determining unit 34 for example starts the pressure drop considering the response of the valve 60, the performance of the vacuum pump 50, etc., calculates the movement of the injection plunger 17 required for reduction to the necessary pressure, and determines the valve position P3 from this. The valve closing position P3 is set to before the speed switching position P4 for switching the injection speed from low speed to high speed.

Figure 3:
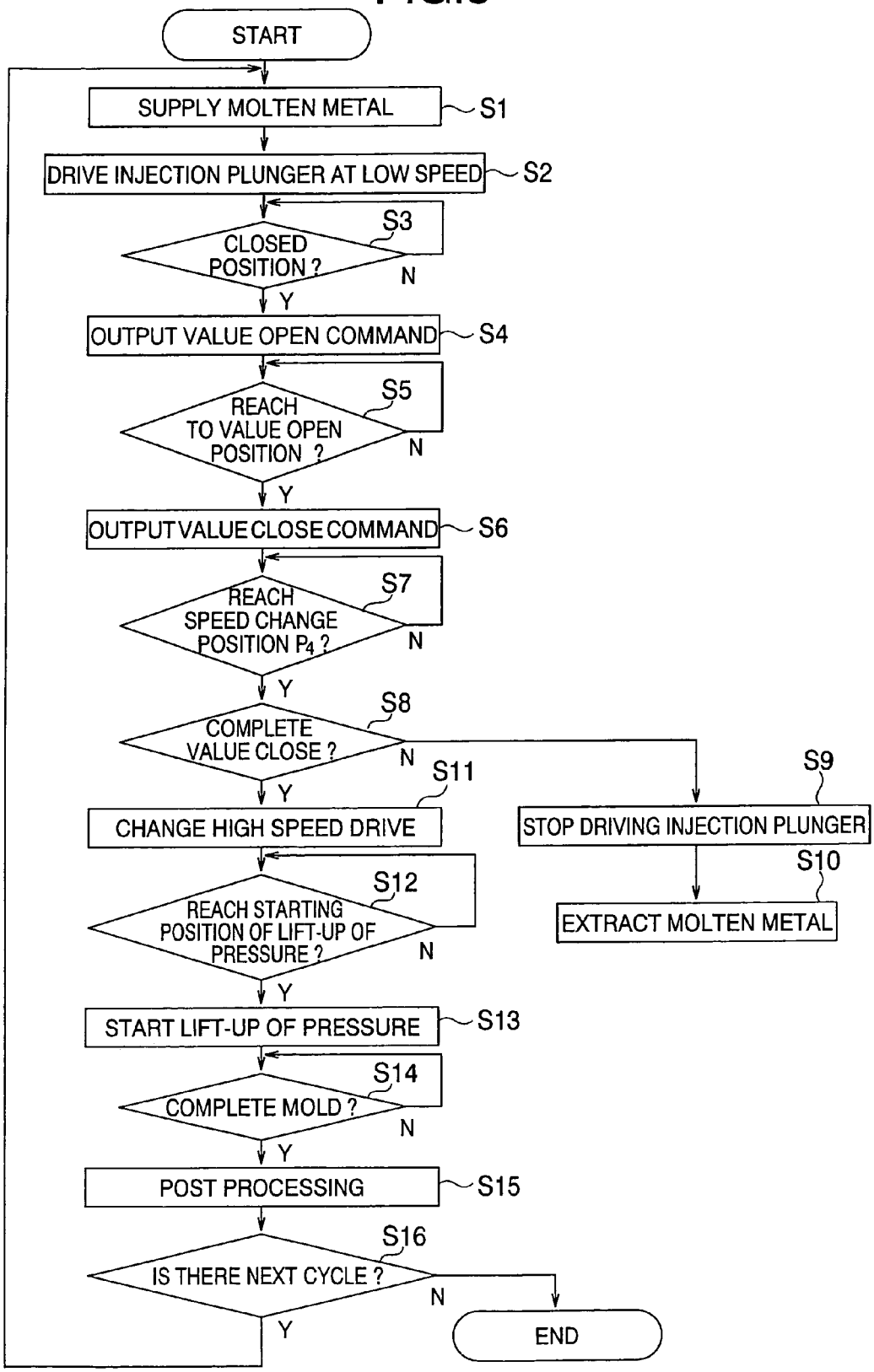
FIG. 3 is a flow chart of an example of a processing routine in a control apparatus in casting by a die casting machine.

Next, an example of processing of the control apparatus 30 in casting by the die casting machine of the above configuration will be explained with reference to the flow chart shown in FIG. 3. First, the control apparatus 30, as shown in FIG. 1, clamps the movable die 3 and fixed die 2, then outputs an instruction to the not shown molten metal feed apparatus and supplies a predetermined amount of molten metal to the injection sleeve 16 (step S1). Note that at this time, the injection plunger 17 (plunger tip 15) is positioned at the initial position P1 for opening the feed port 16*h*. In this state, the pressure P of the cavity C shown in FIG. 1 is equal to ambient pressure. Further, the vacuum pump 50 is started up to place it in an exhaust ready state. Further, the valve 60 is closed.

Figure 4:
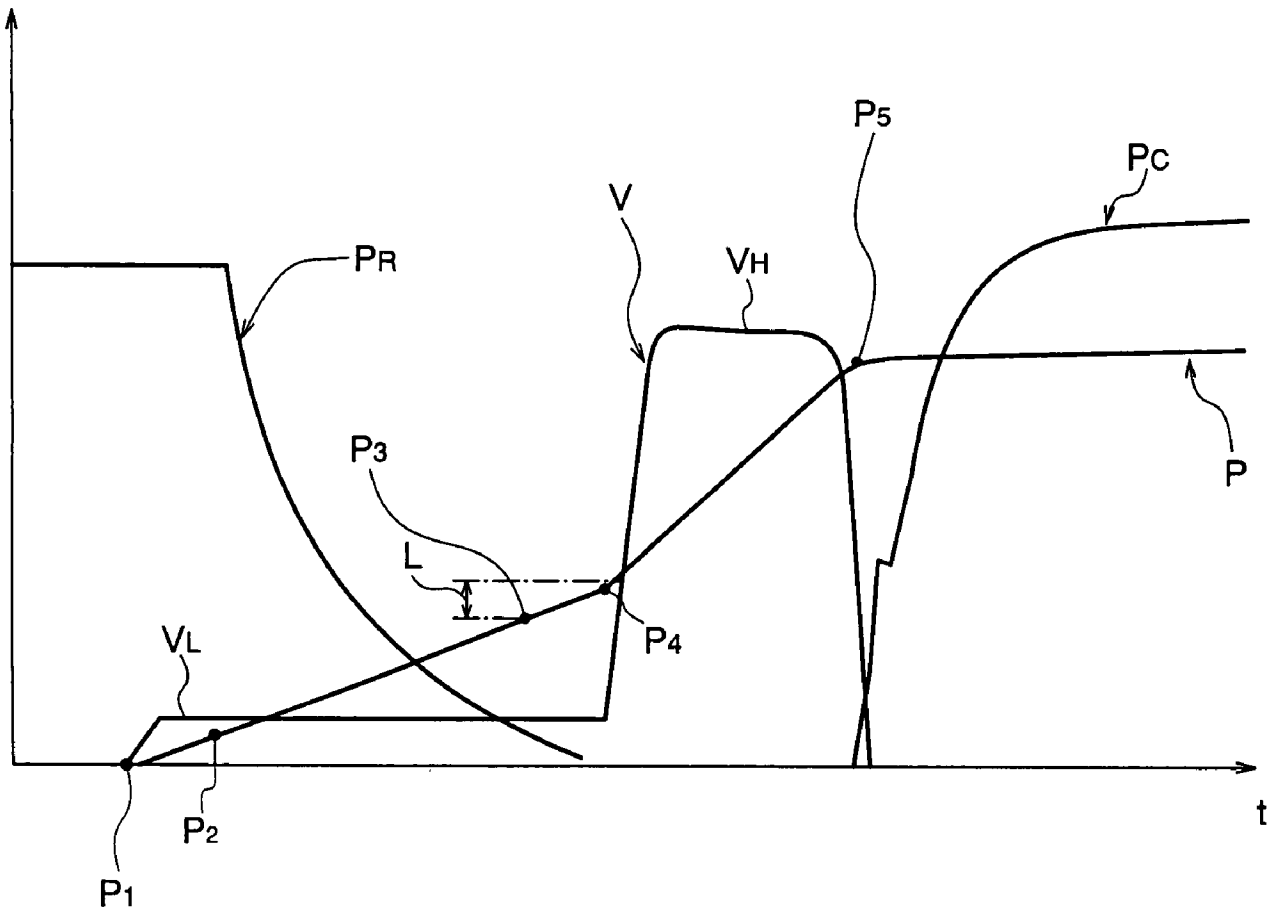
FIG. 4 is a graph of an example of a plunger position, injection speed, casting pressure, and die inside pressure.

The control apparatus 30 drives the injection plunger 17 at a low speed VL injection speed V. Next, the control apparatus 30, as shown in FIG. 4, judges whether the plunger tip 15 has reached the closing position P2 for closing the feed port 16*h* after the injection plunger 17 starts moving from the initial position P1 at the low injection speed VL (step S3).

When the plunger tip 15 reaches the closing position P2 for closing the feed port 16*h*, the inside of the injection sleeve 16 is closed. The control apparatus 30 outputs an instruction for opening the valve 60 to the electromagnetic actuator 61 when judging that the plunger tip 15 has reached the closing position P2 closing the feed port 16*h* (step S4). When receiving this instruction and the exhaust path is opened, as shown in FIG. 4, the die inside pressure Pr (pressure inside the cavity C) rapidly falls from the ambient pressure.

Next, the control apparatus 30 judges if the injection plunger 17 has reached the valve closing position P3 (step S5). The valve closing position P3 is determined in advance in the valve closing position determining unit 34. When the injection plunger 17 reaches the valve closing position P3, in a normal state, the die inside pressure Pr falls to the desired pressure. When the control apparatus 30 judges that the injection plunger 17 has reached the valve closing position P3, a valve closing instruction for closing the exhaust path by the valve 60 is output to the electromagnetic actuator 61 (step S6). After this valve closing instruction is output from the control apparatus 30, there is a time lag until the exhaust path is actually closed by the valve 60. This time lag can change depending on various factors such as the response of the valve 60.

The control apparatus 30 judges if the injection plunger 17 has reached the speed switching position P4 after outputting the valve closing instruction (step S8). The speed switching position P4 is the position of the injection plunger 17 when the front end part of the molten metal in the injection sleeve 16 reaches the gate of the cavity C. When judging that the injection plunger 17 has reached the speed switching position P4, the control apparatus 30 judges if the closing operation of the exhaust path by the valve 60 has been completed (step S9). This judgment is performed based on the position of the valve body 62 detected by the position detector 70 provided at the valve 60. If the valve body 62 moves to the position for reliably closing the exhaust path., it is judged that the closing operation has been completed.

The control apparatus 30 outputs to the oil pressure circuit 40 a control signal for emergency stop of the drive of the injection plunger 17 when judging that the closing operation of the exhaust path by the valve 60 is not completed (step S9). Due to this, the drive of the injection plunger 17 is stopped and the molten metal in the injection sleeve 16 is not injected or filled into the cavity C. In this case, the molten metal remaining in the injection sleeve 16 is exhausted to the outside after the die is opened (step S10).

On the other hand, when it is judged that the closing operation of the exhaust path by the valve 60 has been completed, the control apparatus 30 switches the injection speed V to the high speed VH as shown in FIG. 4 (step S11). Due to this, the molten metal in the injection sleeve 16 is injected and filled into the cavity C. At this time, the valve 60 is reliably closed, so entry of the molten metal into the valve 60 can be reliably prevented.

The control apparatus 30 judges if the injection plunger 17 has reached the pressure increase start position P5 (step S12). The pressure increase start position P5 is the position of the plunger 17 when the molten metal of the injection sleeve 16 is injected and filled into the cavity C and the cavity C is substantially filled with the molten metal. As shown in FIG. 4, if the injection plunger 17 moves to the pressure increase start position P5, the injection pressure V will rapidly fall. Instead, the casting pressure Pc will rise. When it is judged that the injection plunger 17 has reached this pressure increase start position P5, speed control of the oil pressure cylinder 11 is switched to pressure control and the casting pressure Pc is raised (step S13). As shown in FIG. 4, if pressure increase is started, the casting pressure Pc will rapidly rise.

It is judged if the casting operation has been completed (step S14). When completed, the dies are opened, the cast product is ejected, and the dies are cleaned and other post-treatment is performed (step S15). Further, it is judged if further casting is to be performed (step S16). If casting again, the routine returns to step S1.

As explained above, according to the present embodiment, the open/closed state of the valve 60 is actually detected, the pressure drop in the cavity C is started, then the injection plunger 17 is moved through the valve closing position P3 to the speed switching position P4. At that point, it is detected if the closing operation of the exhaust path of the valve 60 has been completed. If not completed, the forcible switching to a high injection speed is canceled. Due to this, it is possible to reliably prevent entry of the molten metal into the valve 60 in the opened state and possible to reliably prevent damage to the valve 60.

Further, according to the present embodiment, the valve closing position determining unit 34 considers various casting conditions to determine the position of the injection plunger 17 when closing the valve 60, that is, the valve closing position P3. By this, a suitable valve closing position P3 is obtained for every set of casting conditions. When the injection plunger 17 moves to the speed switching position P4, the cavity C is reduced to a suitable pressure.

Summarizing the effects of the invention, it is possible to obtain a suitable reduced pressure and reliably prevent the entry of the molten metal into a valve when reducing the pressure in a cavity and injecting and filling it with the molten metal for casting.

While the invention has been described with reference to specific embodiments chosen for purpose of illustration, it should be apparent that numerous modifications could be made thereto by those skilled in the art without departing from the basic concept and scope of the invention.

What we claim is:

1. A die casting machine for exhausting a cavity defined between a pair of dies to reduce the pressure in the cavity and for injecting and filling a molten metal into said reduced pressure cavity to form a cast product, comprising:

a valve for opening and closing an exhaust path for exhausting the inside of said cavity;

a value operation detecting means for detecting an opened state or closed state of said exhaust path by operation of said valve;

an injection apparatus including an injection sleeve in communication with said valve, an injection plunger for injecting the molten metal supplied to said injection sleeve, and a drive means for driving said injection plunger;

a plunger position detecting means for detecting a position of said injection plunger; and a control means including a cast condition holding means for holding a cast condition, a valve control means for controlling a drive of the valve, a valve closed position determining means for determining a closed position of the valve, and an injection controlling means for controlling a drive of the drive means in the injection apparatus, in accordance with the cast condition held in the cast condition holding means, to drive said injection plunger at a low injection speed defined by the cast condition after the molten metal is supplied to said injection sleeve, for switching to a high injection defined by the cast condition speed from the low speed when a speed switching position defined by the cast condition is reached, and for making the molten metal to be injected and filled into said reduced pressure cavity, said injection controlling means outputting control instructions to the valve control means for closing the valve so as to close said exhaust path when the position of said injection plunger detected by the plunger position detecting means reaches a valve closing position defined by the cast condition before reaching said speed switching position, and to the drive means in the injection apparatus for stopping the drive of said injection plunger when the valve closed position determining means does not detect completion of closure of said exhaust path when said injection plunger reaches said speed switching position.

2. A casting method for exhausting a cavity defined between a pair of dies to reduce the pressure in the cavity and for injecting and filling a molten metal into said reduced pressure cavity to form a cast product, comprising:

feeding a molten metal to an injection sleeve in communication with said cavity;

driving an injection plunger for injecting the molten metal at a low injection speed defined by a cast condition after the molten metal is supplied to said injection sleeve;

starting reduction of pressure inside said cavity;

closing the valve to close the exhaust path when the position of the injection plunger reaches a valve closing position defined by the cast condition; and switching to a high injection speed defined by the cast condition from a low speed when a speed switching position defined by the cast condition is reached to inject and fill the molten metal into the reduced pressure cavity;

stopping the drive of the injection plunger when completion of closure of the exhaust path is not detected when the injection plunger reaches the speed switching position.

* * * * *